United States Patent [19]

Garg

[11] Patent Number: 4,617,106

[45] Date of Patent: Oct. 14, 1986

[54] CATALYSTS FOR COAL LIQUEFACTION PROCESSES

[75] Inventor: Diwakar Garg, Macungie, Pa.

[73] Assignee: Air Products and Chemicals, Inc., Allentown, Pa.

[21] Appl. No.: 780,507

[22] Filed: Jul. 26, 1985

[51] Int. Cl.[4] ..... C10G 1/06

[52] U.S. Cl. ..... 208/418; 208/420; 208/421; 208/423

[58] Field of Search ..... 208/10

[56] References Cited

U.S. PATENT DOCUMENTS

| | | | |
|---|---|---|---|
| 1,845,555 | 2/1932 | Pier et al. | 208/10 |
| 1,863,669 | 6/1932 | Pier et al. | 208/8 LE |
| 1,922,499 | 8/1933 | Pier et al. | 208/10 |
| 1,970,248 | 8/1934 | Pier et al. | 208/10 X |
| 1,994,075 | 3/1935 | Krauch et al. | 208/10 |
| 2,227,672 | 1/1941 | Pier et al. . | |
| 3,183,180 | 5/1965 | Schuman et al. | 208/143 |
| 3,532,617 | 10/1970 | Hodgson | 208/10 |
| 3,619,404 | 11/1970 | Rieve et al. | 208/10 |
| 3,745,108 | 7/1973 | Schuman et al. | 208/10 |
| 3,923,634 | 12/1975 | Silvestri et al. | 208/10 |
| 4,111,787 | 5/1978 | Aldridge et al. | 208/10 |
| 4,396,786 | 8/1983 | Bond et al. | 208/10 |
| 4,472,263 | 9/1984 | Garg et al. | 208/8 LE |
| 4,486,293 | 12/1984 | Garg | 208/10 |

FOREIGN PATENT DOCUMENTS

| | | | |
|---|---|---|---|
| 20463 | of 1929 | Australia | 208/10 |
| 21112 | of 1929 | Australia | 208/10 |
| 54-124006 | 9/1979 | Japan | 208/10 |
| 56-50991 | 5/1981 | Japan | 208/10 |
| 0272830 | 6/1927 | United Kingdom | 208/10 |
| 322489 | 12/1929 | United Kingdom | 208/10 |
| 339317 | 12/1930 | United Kingdom | 208/10 |

*Primary Examiner*—John Doll
*Assistant Examiner*—William G. Wright
*Attorney, Agent, or Firm*—Geoffrey L. Chase; E. Eugene Innis; James C. Simmons

[57] ABSTRACT

Improved catalysts for catalytic solvent refining or hydroliquefaction of non-anthracitic coal at elevated temperatures under hydrogen pressure in a hydrogen donor solvent comprise a combination of zinc or copper, or a compound thereof, and a Group VI or non-ferrous Group VIII metal, or a compound thereof.

30 Claims, No Drawings

CATALYSTS FOR COAL LIQUEFACTION PROCESSES

TECHNICAL FIELD

The Government of the United States of America has rights in this invention pursuant to Contract No. DE-AC22-82-PC50003 awarded by the U.S. Department of Energy.

The present invention is directed to a process for making synthetic fuels from non-anthracitic coals. The process relates to producing liquid hydrocarbons and normally solid solvent-refined coal from raw mined coal, which has not been substantially pretreated. The present process is directed to improved solvent refining or coal liquefaction processes, in which the hydroliquefaction step in the presence of a hydrogen donor solvent at high temperature under hydrogen pressure is done using a Group VI or non-ferrous Group VIII metal or metal compound, admixed with copper or zinc, or compounds thereof.

BACKGROUND ART

The art of coal treatment to upgrade coal and provide alternative fuels, particularly liquid fuels to replace petroleum-derived liquid fuels, was first studied intensively in Germany in the 1920's. Research in the technology of coal upgrading has continued up to the present time, and was particularly active during the worldwide oil shortages of the 1970's.

Techniques for recovering more-easily utilized fuels from raw coal are generally known as coal liquefaction. Coal liquefaction can employ a wide variety of non-anthracitic substrates, particularly bituminous, sub-bituminous and lignitic coals. Other organic materials, e.g. peat can also be used.

Coal liquefaction processes broadly include both thermal (non-catalytic) and catalytic procedures. In thermal processes, heat is used to liquefy the coal without addition of extraneous catalytic materials. In thermal coal liquefaction processes, however, minerals, especially iron-bearing species, naturally found in the coal substrate may function as catalysts for the process.

Pier et al. have proposed, in U.S. Pat. No. 2,227,672, thermal treatment of carbonaceous materials, specifically middle oil, tars or coal, with supported sulfide-containing catalysts based on a combination of iron, manganese, copper or zinc; plus a strong hydrogenation catalyst selected from molybdenum, tungsten, cobalt, rhenium, vanadium or nickel.

Schuman et al. (U.S. Pat. No. 3,745,108) have disclosed a process for hydrogenating coal, using a liquid medium containing at least 25% by weight of water and temperatures below about 375° C.

The use of supported catalysts for coal liquefaction has been disclosed by Rieve et al. in U.S. Pat. No. 3,619,404. The process is one in which substantially no liquid slurry material is used and is reported to give lower yields of asphaltenes, than when a slurry medium is used.

Hodgson (U.S. Pat. No. 3,532,617) has recited hydroconversion of coal with a combination of catalysts, one impregnated on the coal and the other supported on a refractory oxide.

Schuman et al, in U.S. Pat. No. 3,183,180, have proposed a process for hydrogenation of oils or coal using, for example, cobalt molybdate on alumina catalyst. Ash, char and unconverted coal are recycled to improve the process.

Garg, in U.S. Pat. No. 4,486,293, herein incorporated by reference, has proposed liquefaction of coal in a hydrogen donor solvent, in the presence of hydrogen and a co-catalyst combination of iron and a Group VI or Group VIII non-ferrous metal or compounds of the catalytic metals.

Coal liquefaction processes attempt to bring about cleavage of weak heteroatom to carbon and strong carbon to carbon linkages in the coal structure. In the context of coal liquefaction, heteroatoms include nitrogen, oxygen and sulfur, bonded in any fashion to carbon of coal. The intermediate free radicals, resulting from cleavage of carbon-heteroatom and carbon-carbon bonds, are hydrogenated during liquefaction to prevent polymerization of the thus-produced free radicals to high molecular weight structures.

Although hydrogen performs the necessary function of hydrogenation in coal liquefaction, it has been found that introduction of hydrogen by a hydrogen donor solvent is preferable to use of gaseous hydrogen alone. Hydrogen donor solvents must dissolve the products from coal liquefaction and must be capable of reversible hydrogenation and dehydrogenation. The donor solvent therefore functions as a hydrogen carrier, upon which hydrogen is loaded and introduced into the reaction mixture. Hydrogenated donor solvent then transfers hydrogen to free radicals generated during coal liquefaction and the hydrogen-depleted solvent is separated from the products and is rehydrogenated before recycling to the coal liquefaction reaction.

Both catalytic and non-catalytic coal liquefaction processes can be performed in a variety of reactors, including slurry phase reactors and fluidized bed reactors.

DISCLOSURE OF INVENTION

In one aspect, this invention relates to an improved process for catalytic solvent refining of coal at an elevated temperature and pressure in the presence of hydrogen and a hydrogen donor solvent, boiling above 230° C., to produce liquid hydrocarbons and normally solid solvent-refined coal, wherein the improvement comprises employing a catalyst of either zinc or copper, or a compound thereof, plus a Group VI metal or a non-ferrous Group VIII metal, or a compound thereof.

In hydroliquefaction processes, particulate coal is slurried with hydrogen donor solvent and heated, in the presence of hydrogen at elevated temperatures, generally above 350° C., to convert the coal to products of lower molecular weight.

The coal feed, used for hydroliquefaction or solvent refining, is selected from non-anthracitic coals, including bituminous, sub-bituminous and lignite coals. Peat and similar organic feedstocks may also be used in these processes. The coals can be used directly or can be treated preliminarily by known processes for removal of mineral matter. The feed coal should be dried and ground to a suitable particle size (60 mesh or finer). Although coal can sometimes be used for hydroliquefaction without preliminary treatment, it is preferred to dry the coal to reduce moisture levels to those adequately handled in coal slurry equipment. This generally means that the coals contains 5% or less by weight of water.

The catalyst system, used in the process of the present invention, requires two components. The first component is copper or zinc, or a corresponding compound. The catalysts therefore will contain copper or zinc metal or, preferably, a water-soluble copper or zinc compound. Typical compounds are copper sulfate, copper chloride, copper acetate, copper nitrate, copper oxalate, zinc chloride, zinc sulfate, zinc nitrate, zinc oxalate, zinc acetate, zinc bromide, etc. It will be understood that oil-soluble compounds, e.g. copper or zinc naphthenate, octoate, etc. can also be used. Oil-soluble compounds are disclosed by Aldridge et al. (U.S. Pat. No. 4,111,787), incorporated herein by reference. The level of copper or zinc metal in the catalyst system will be above about 0.05% by weight (500 ppm), with respect to coal feed. The amount of copper or zinc metal can vary up to about 3% by weight. Preferably the amount of copper or zinc (or compound) will be 5000–20,000 ppm, with respect to coal feed. Most preferably, the amount of copper or zinc is 5000–15,000 ppm.

Contemplated equivalents of copper or zinc in the co-catalyst systems of this invention include other metals of Groups IB, IIB, IVB, VA or VIIA, particularly manganese, cadmium, lead or tin.

The second component of the catalyst is a metal or compound of a metal selected from Group VI and non-ferrous Group VIII metals. It is preferred that the metals or compounds of Group VI metals be selected from tungsten and molybdenum and those from non-ferrous Group VIII metals be selected from cobalt and nickel. The amount of second catalyst is at least 50 ppm, with respect to coal feed. Generally, the maximum amount of Group VI or Group VIII non-ferrous metal will not exceed 5000 ppm. Preferably, the amount of Group VI or non-ferrous Group VIII metal is 100–1000 ppm, with respect to coal feed. Accordingly, ratios of copper or zinc to Group VI or non-ferrous Group VIII metals are 300:1 to 1:2, referred to elemental metals. However, it is preferred for the copper or zinc catalyst component to be present in excess of the Group VI or non-ferrous Group VIII metal. Therefore, ratios of 50:1 to 1:1 are preferred.

Representative compounds which can be used are ammonium molybdate, ammonium tungstate, ammonium rhenate, phosphomolybdic acid, nickel chloride, nickel nitrate, nickel sulfate, cobalt nitrate, cobalt sulfate, or the like. Oil-soluble compounds of the metals, such as octoates or naphthanates, as disclosed in U.S. Pat. No. 4,111,787, can also be used.

It is preferred to impregnate the coal feed (60–400 mesh) with a combination of catalytic metals prior to or during preparation of the coal slurry mix being fed to the liquefaction reactor. The coal may be impregnated with a solution of both metal compounds in water or in organic solvents. The catalyst need not contain sulfides.

The hydrogen donor solvent used in solvent refining processes is a essentially a mixture of hydrocarbons, boiling above about 230° C. Although the solvent is conveniently derived from the coal feed being liquefied, it is feasible to use hydrogen donor solvents of the proper boiling range, obtained from petroleum, shale or tar sands. These solvents may be identified as anthracene oil, hydrogenated anthracene oil, creosote oil, hydrogenated creosote oil, or other coal- or petroleum-derived solvents. It will be understood that, in processes in which solvent is recycled, solvents of other origins will gradually be replaced by coal-derived solvent. In general, solvent used for hydroliquefaction will be selected from among those having a boiling range of 230°–455° C. It is preferred for the hydrogen donor solvents used in the practice of this invention to be essentially anhydrous, that is, free of added water. It is further preferred to use process-derived solvent in the practice of this invention and to recycle solvent to the process.

The particulate feed coal, impregnated with the dual catalyst composition, is slurried with hydrogen donor solvent, containing essentially no added water. It is customary to use coal:solvent ratios of 1:1 to 1:10 by weight. That is, the slurries will customarily contain about 10–50% by weight of coal. It is preferred that the slurry contain 20–45% by weight of coal, more preferably 30–45% by weight.

The slurry mix can also contain solvent refined coal (SRC) recyled from the solid-liquid separation step. Solvent refined coal is a solid at room temperature. The amount of SRC can be 0–35% by weight of solvent.

The temperature in the slurry mix tank is maintained at the selected temperature, generally up to 235° C., by controlling the temperature of the recycled solvent and recycled SRC. In the slurry mix tank, it is feasible to remove moisture entrained in the feed coal, as steam escaping from the mixing tank. The slurry can then be transferred to a preheater.

The feed slurry and hydrogen can be preheated in a preheater to the desired reaction temperature. It is preferred that the outlet temperature of the preheater is 375°–455° C., more preferably 375°–425° C., and that the temperature in the hydroliquefaction reactor is 400°–485° C. The residence time of the slurry in the hydroliquefaction reactor is 5–300 minutes, preferably 5–60 minutes. The hydrogen flow rate is normally 62.4–936 $m^3$/metric ton of coal. Hydrogen used in the preheater can also contain hydrogen sulfide.

The preheated feed is then transferred to the liquefaction reactor, in which the temperature is above about 400° C. Preferably, liquefaction is done at 400°–450° C. under hydrogen pressure of $3.51–35.1\times10^5$ kg/$m^2$. Preferred pressures are $7.03–14.1\times10^5$ kg/$m^2$. The hydrogen flow rate to the reactor is 468–1560 $m^3$/metric ton of coal, preferably 624 $m^3$/metric ton of coal.

It will be understood that a number of chemical transformations take place in the hydroliquefaction reactor. The preferred conversions include those of coal to distillate oil. Products from the hydroliquefaction reactor are passed through a gas-liquid separator to recover product gases and unused hydrogen, which is recycled. The condensed phase is further treated to recover net distillate products and process solvent, part of which may be withdrawn as a net distillate oil product. More particularly, product is withdrawn as $C_1$–$C_5$ hydrocarbon gases and oil (bp 150°–455° C.) fractions.

Recovered process solvent, boiling in the 230°–455° C. range, can be recycled to the process. The distillation bottoms can be further separated to recover unconverted coal, minerals and ash, using methods well known in the art, including filtration, sub-critical and super-critical solvent deashing, and anti-solvent deashing. Deashed and demineralized distillation bottoms are identified as solvent-refined coal (SRC), a solid at room temperature, which is withdrawn as net product. The SRC can be used as a feedstock for making anode coke, used as boiler fuel, or recycled to make additional distillate oil. The SRC can also be subjected to hydroprocessing in a hydrotreating or hydrocracking unit to make additional oil. The residue containing unconverted coal, minerals and ash can be gasified to make hydrogen.

BEST MODE FOR CARRYING OUT THE INVENTION

In a most preferred aspect, the process of the invention is that wherein hydrogen pressure is maintained with hydrogen gas between $3.51\times10^5$ and $3.51\times10^6$ kg/m$^2$; hydrogen donor solvent is obtained from the process, is recycled to the process and is free of added water; and the catalyst comprises 5000–15,000 ppm of copper or zinc sulfate and 100–1000 ppm of ammonium molybdate with respect to feed coal.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the following examples, temperatures are set forth uncorrected in degrees Celsius. Unless otherwise indicated, all parts and percentages are by weight.

EXAMPLE 1

Thermal Hydroliquefaction of Coal with Coal-derived Process Solvent

A slurry of 3 g of Illinois no. 6 coal, of the composition given in Table 1, in 6 g of solvent, derived from the hydroliquefaction process and having the elemental composition and boiling range given in Table 2, was prepared.

The coal-solvent slurry was treated in a 46.7-mL tubing-bomb reactor, stirred at 860 rpm, under a hydrogen pressure before heating of $8.78\times10^5$ kg/m$^2$. The hydroliquefaction was carried out as in U.S. Pat. No. 4,472,263, herein incorporated by reference. The reaction temperature was 425° C. and residence time was 60 min.

At the end of the 60-minute reaction period, the reactor was cooled and the product separated into gas and slurry. The slurry was further divided into an oil fraction (n-pentane soluble), solvent-refined coal (SRC, insoluble in n-pentane, soluble in methanol:methylene chloride 10:90 by volume) and insoluble organic materials (IOM, insoluble in n-pentane and methanol:methylene chloride mixture).

The product distribution is given in Table 3. The yield of oil was 17%, based on moisture-ash-free (MAF) coal, and the conversion of coal was 87%.

EXAMPLE 2

Hydroliquefaction of Coal with Molybdenum Catalyst

A coal sample (3 g), otherwise as in Example 1, was impregnated with 250 ppm of molybdenum (as ammonium molybdate from an aqueous solution) and charged to the tubing bomb with 6 g of process-derived solvent. Liquefaction was carried out as in Example 1.

As shown in Table 3, higher conversion of coal occurred and the yield of oil was higher than for an uncatalyzed reaction.

TABLE 1

| Analysis of Illinois #6 Coal | Weight % (as received basis) |
|---|---|
| Proximate Analysis | |
| Moisture | 2.54 |
| Ash | 10.46 |
| Volatile | 37.56 |
| Fixed Carbon | 49.44 |
| Ultimate Analysis | |
| Carbon | 68.43 |
| Hydrogen | 4.96 |
| Nitrogen | 1.38 |
| Sulfur | 3.23 |
| Oxygen (by difference) | 8.93 |
| Distribution of Sulfur | |
| Total Sulfur | 3.23 |
| Pyrite Sulfur | 1.09 |
| Organic Sulfur | 2.14 |

TABLE 2

| | Weight % |
|---|---|
| Analysis of the Solvent | |
| Carbon | 88.02 |
| Hydrogen | 8.57 |
| Oxygen | 2.25 |
| Nitrogen | 0.67 |
| Sulfur | 0.62 |
| Boiling Point Distribution of the Solvent | |
| Temperature, °C. | |
| IBP-177 | 0.00 |
| 177–232 | 2.80 |
| 232–288 | 10.77 |
| 288–343 | 28.55 |
| 343–399 | 25.23 |
| 399–454 | 29.89 |
| 454-FBP | 2.76 |

TABLE 3

Conversion and Product Distribution on MAF Coal

| | Example 1 | Example 2 250 ppm | Example 3 1% Cu | | | Example 4 1% Cu and 250 ppm Mo | | Example 5 1% Zn | | Example 6 1% Zn and 250 ppm Mo | |
|---|---|---|---|---|---|---|---|---|---|---|---|
| Catalyst | None | Mo | I | II | III | I | II | I | II | I | II |
| Gas[a] | 12.0 | 10.2 | 11.7 | 12.2 | 10.4 | 10.9 | 8.9 | 9.5 | 10.5 | 7.4 | 8.2 |
| Oil[b] | 17.6 | 23.9 | 15.9 | 14.1 | 14.3 | 29.7 | 27.4 | 18.9 | 15.4 | 32.8 | 31.4 |
| SRC[c] | 57.3 | 56.7 | 58.5 | 54.3 | 57.6 | 52.2 | 54.7 | 57.0 | 58.8 | 52.7 | 52.7 |
| IOM[d] | 13.1 | 9.2 | 13.9 | 19.3 | 17.8 | 7.2 | 8.9 | 14.7 | 15.3 | 7.1 | 7.6 |
| Conversion (%) | 86.9 | 90.8 | 86.1 | 80.7 | 82.2 | 92.8 | 91.1 | 85.3 | 84.7 | 92.9 | 92.4 |

[a] $C_1$–$C_5$ hydrocarbons, hydrogen sulfide, ammonia, CO, and carbon dioxide
[b] soluble in n-pentane
[c] insoluble in n-pentane and soluble in methylene chloride/methanol mixture
[d] insoluble in n-pentane and methylene chloride/methanol mixture

EXAMPLE 3

Hydroliquefaction of Coal with Copper Catalyst

Coal samples, otherwise as in Example 1, were impregnated with 1% by weight of copper sulfate. Three grams of thus-impregnated coal were charged, with 6 g of process-derived solvent, to the tubing-bomb reactor and subjected to hydroliquefaction conditions of Example 1.

As shown by results of triplicate runs, set forth in Table 3, conversion of coal was generally lower than for catalyst-free coal and yields of oil fraction were lower. These results show that copper alone inhibits the hydroliquefaction reaction.

EXAMPLE 4

Hydroliquefaction of Coal with Copper-Molybdenum Dual Catalyst System

A coal sample, otherwise as in Example 1, was impregnated with 1% by weight of copper sulfate and 250 ppm of ammonium molybdate. The impregnated coal (3 g) was charged with 6 g of process-derived solvent to the tubing-bomb reactor and subjected to hydroliquefaction under the conditions of Example 1.

As shown by the results in Table 3, both oil yield and conversion were higher than for uncatalyzed hydroliquefaction or for hydroliquefaction, catalyzed by copper or molybdenum alone.

EXAMPLE 5

Hydroliquefaction of Coal with Zinc Catalyst

Coal of Example 1 was impregnated with 1% by weight of zinc sulfate and subjected to hydroliquefaction, under conditions of Example 1.

Results, given in Table 3, show that oil yields were similar to those for an uncatalyzed reaction, but that conversion was slightly lower.

EXAMPLE 6

Hydroliquefaction of Coal with Zinc-Molybdenum Dual Catlayst System

Coal, as in Example 1, was impregnated with 1% by weight of zinc sulfate and 250 ppm of ammonium molybdate. Hydroliquefaction of the thus-impregnated coal was carried out as in Example 1.

As shown in Table 3, liquefaction catalyzed by zinc plus molybdenum resulted in significantly higher oil yields and conversions, than for uncatalyzed hydroliquefaction or for hydroliquefaction, catalyzed by a single metal.

I claim:

1. In a process for catalytic solvent refining of coal at a temperature above 400° C. in the presence of hydrogen and a hydrogen donor solvent, the improvement comprising using as catalyst a combination consisting essentially of:

(a) copper or a compound thereof, and (b) a Group VI or non-ferrous Group VIII metal, or a compound of either.

2. The process of claim 1, wherein the catalyst is free of sulfide.

3. The process of claim 1, wherein the pressure is $3.51\times10^5$–$3.51\times10^6$ kg/m$^2$.

4. The process of claim 1, wherein pressure is maintained using hydrogen gas.

5. The process of claim 1, wherein the hydrogen donor solvent is obtained from the process and is recycled to the process.

6. The process of claim 1, wherein the hydrogen donor solvent is free of added water.

7. The process of claim 1, wherein the Group VI metal is molybdenum or tungsten, or a compound of either, and the non-ferrous Group VIII metal is cobalt or nickel, or a compound of either.

8. The process of claim 1, wherein the catalyst contains copper and molybdenum or compounds of either.

9. The process of claim 1, wherein the ratio of copper to Group VI or non-ferrous Group VIII metal is 50:1 to 1:1, referred to elemental metal.

10. The process of claim 1, wherein the catalyst comprises ammonium molydate and copper sulfate.

11. The process of claim 1, wherein coal feed is impregnated with a solution of catalyst components.

12. The process of claim 1, wherein the catalyst comprises 5000–15,000 ppm of copper or a compound thereof, and 100–1000 ppm of Group VI metal or non-ferrous Group VIII metal, or a compound of either, with respect to feed coal.

13. The process of claim 1, wherein the catalyst comprises 5000–15,000 ppm of copper sulfate and 100–1000 ppm of ammonium molybdate with respect to feed coal.

14. The process of claim 1, wherein hydrogen pressure is maintained with hydrogen gas between $3.51\times10^5$ and $3.51\times10^6$ kg/m$^2$; hydrogen donor solvent is obtained from the process, is recycled to the process and is free of added water; and the catalyst comprises 5000–15,000 ppm of copper or a compound of thereof, and 100–1000 ppm of Group VI metal or non-ferrous Group VIII metal, or a compound of thereof, with respect to feed coal.

15. The process of claim 1, wherein hydrogen pressure is maintained with hydrogen gas between $3.51\times10^5$ and $3.51\times10^6$ kg/m$^2$; hydrogen donor solvent is obtained from the process, is recycled to the process and is free of added water; and the catalyst comprises 5000–15,000 ppm of copper sulfate and 100–1000 ppm of ammonium molybdate with respect to feed coal.

16. The process of claim 1, wherein the Group VI metal is molybdenum or tungsten, or a compound of either, and the non-ferrous Group VIII metal is cobalt or nickel, or a compound of either.

17. In a process for catalytic solvent refining of coal at a temperature above 400° C. in the presence of hydrogen and a hydrogen donor solvent, the improvement comprising using as catalyst a sulfide-free combination consisting essentially of:

(a) zinc or a compound thereof, other than zinc oxide, and (b) a Group VI or non-ferrous Group VIII metal, or a compound of either, provided that the Group VI compound is other than molybdic acid.

18. The process of claim 17, wherein the pressure is $3.51\times10^5$–$3.51\times10^6$ kg/m$^2$.

19. The process of claim 17, wherein pressure is maintained using hydrogen gas.

20. The process of claim 17, wherein the hydrogen donor solvent is obtained from the process and is recycled to the process.

21. The process of claim 17, wherein the hydrogen donor solvent is free of added water.

22. The process of claim 17, wherein the catalyst contains zinc and molybdenum or compounds of either.

23. The process of claim 17, wherein the catalyst comprises a zinc compound selected from zinc chloride, zinc sulfate, zinc nitrate, zinc oxalate, zinc acetate, zinc bromide, zinc octoate or zinc naphthenate and a molybdenum compound selected from ammonium molybdate or phosphomolybdic acid.

24. The process of claim 17, wherein the ratio of zinc to Group VI or non-ferrous Group VIII metal is 50:1 to 1:1, referred to elemental metal.

25. The process of claim 17, wherein the catalyst comprises ammonium molybdate and zinc sulfate.

26. The process of claim 17, wherein coal feed is impregnated with a solution of catalyst components.

27. The process of claim 17, wherein the catalyst comprises 5000–15,000 ppm of zinc, or a compound thereof, and 100–1000 ppm of Group VI metal or non-ferrous Group VIII metal, or a compound of either, with respect to feed coal.

28. The process of claim 17, wherein the catalyst comprises 5000–15,000 ppm of zinc sulfate and 100–1000 ppm of ammonium molybdate with respect to feed coal.

29. The process of claim 17, wherein hydrogen pressure is maintained with hydrogen gas between $3.51\times10^5$ and $3.51\times10^6$ kg/m$^2$; hydrogen donor solvent is obtained from the process, is recycled to the process and is free of added water; and the catalyst comprises 5000–15,000 ppm of zinc, or a compound thereof, and 100–1000 ppm of Group VI metal or non-ferrous Group VIII metal, or a compound of either, with respect to feed coal.

30. The process of claim 17, wherein hydrogen pressure is maintained with hydrogen gas between $3.51\times10^5$ and $3.51\times10^6$ kg/m$^2$; hydrogen donor solvent is obained from the process, is recycled to the process and is free of added water; and the catalyst comprises 5000–15,000 ppm of zinc sulfate and 100–1000 ppm of ammonium molybdate with respect to feed coal.

* * * * *

UNITED STATES PATENT AND TRADEMARK OFFICE

CERTIFICATE OF CORRECTION

PATENT NO. : 4,617,106

DATED : October 14, 1986

INVENTOR(S) : Diwakar Garg

It is certified that error appears in the above-identified patent and that said Letters Patent is hereby corrected as shown below:

On the title page, the filing date, item number [22], of this application "Jul. 26, 1985", should be --Sept. 26, 1985--.

Signed and Sealed this

Tenth Day of February, 1987

*Attest:*

DONALD J. QUIGG

*Attesting Officer*

*Commissioner of Patents and Trademarks*